US006776319B1

(12) United States Patent
Haselwander

(10) Patent No.: US 6,776,319 B1
(45) Date of Patent: Aug. 17, 2004

(54) STRAND TENSION EQUALIZING APPARATUS

(76) Inventor: Jack G. Haselwander, 726 Morning Shadows Dr., Chattanooga, TN (US) 37421

( * ) Notice: Subject to any disclaimer, the term of this patent is extended or adjusted under 35 U.S.C. 154(b) by 0 days.

(21) Appl. No.: 10/123,633

(22) Filed: Apr. 15, 2002

(51) Int. Cl.[7] ..... B65H 23/18; D02H 13/22; D03D 49/06

(52) U.S. Cl. ..... 226/42; 28/194; 139/103; 139/109; 242/131; 242/418.1

(58) Field of Search ..... 226/42, 111, 178; 242/131, 131.1, 418.1; 139/103, 109, 110; 28/194

(56) References Cited

U.S. PATENT DOCUMENTS 908,255 A * 12/1908 Hardman ..... 242/156.2
2,499,888 A * 3/1950 Taylor ..... 226/195
2,578,018 A * 12/1951 Rovas ..... 242/131.1
4,087,956 A * 5/1978 Gre ..... 57/58.54
4,150,800 A * 4/1979 Clausen et al. ..... 242/131
5,031,847 A * 7/1991 Tanaka ..... 242/418.1
5,259,421 A * 11/1993 Alexander et al. ..... 226/42
5,738,030 A * 4/1998 Ok ..... 112/475.23
5,857,496 A * 1/1999 Brown et al. ..... 139/110
5,957,359 A * 9/1999 Paivinen ..... 242/418

* cited by examiner

*Primary Examiner*—Michael R. Mansen
(74) *Attorney, Agent, or Firm*—Stephen J. Stark; Miller & Martin PLLC

(57) ABSTRACT

A tension device is utilized for equalizing, or at least reducing differentials in tension across strands in a web. The device utilizes an overfeed roll which rotates faster than the speed of feeding the web. Strands at the desired tension, or less, slip about the exterior surface of the overfeed roll. Strands which are greater than the desired tension have sufficient friction to be rotated, at least temporarily, by the overfeed roll to thereby create slack in the higher tension strands to equalize the tension relative to the other strands. Feedback from feed rolls, support rolls, and/or the overfeed roll may be utilized to adjust the speed of the overfeed roll.

19 Claims, 3 Drawing Sheets

STRAND TENSION EQUALIZING APPARATUS

BACKGROUND OF THE INVENTION

The present invention relates to an apparatus which equalizes, or at least reduces differences in tension, among a web comprising a multiplicity of strands, and more particularly to an apparatus designed to overfeed tighter strands in order to loosen those strands with an overfeed roll.

Many industry segments utilize multiple strands of elongated elements in various processes. In some processes, multiple strands are preferably fed at a substantially uniform tension to reduce or prevent unwanted effects. Various industries including the carpet industry, textile industry, tire cord industry, and others have processes where multiple strands are preferably fed at substantially the same tension. In fact, some problems can occur when particular strands in a web are at a significantly higher tension than others.

In the carpet industry, a tufting machine is generally utilized to tuft yarn into a backing to produce carpet having pile extending from a surface. The tufting machine generally has a multiplicity of needles, each fed with a strand of yarn. The yarn strands are typically fed to the tufting machine from a creel. When fed from a creel, some of the yarn strands are closer to the tufting machine than others. Other yarn strands travel through a more tortuous path than others. Accordingly, the resistance to movement is greater among some strands than others.

When yarn strands are fed to a tufting machine, those which have a higher resistance typically exhibit a higher tension than some others. Additionally, resistance may vary at different times on strands for many different reasons. When a higher tension yarn is run through the tufting machine, undesired effects could include the tufting of loops which are not the same height as those from "looser" yarn ends. If one were attempting to tuft a particular level over a section of carpet, the presence of a higher or a lower loop could be noticeable and cause the carpet product to be rejected. In cut pile carpets such an effect could require excessive tip shearing. Accordingly a need exists to equalize tension across multiple yarn ends.

The typical approach in the carpet industry has been to try to control tension in the individual strands which are slack, or exhibit a low tension. Many patents are believed to be directed to devices which apply tension to lower tension yarn strands. For instance U.S. Pat. No. 908,255 shows a braking system which increases tension on lower tension strands.

Other tension control devices utilize two successive wheels where yarn is completely wrapped around both wheels. U.S. Pat. No. 5,957,359 provides yarn to a first wheel which has a greater diameter than a second wheel, about which the yarns then pass. The first wheel "supplies more length of fibre to the space between the wheels" than which passes over the second wheel (Col. 3, lines 23–35). Thus, all the tensions are raised at the first wheel, and then lowered between the first and second wheel due to the slightly slower speed of the second wheel. U.S. Pat. No. 4,087,956 appears to have somewhat similar double roll wrapped structure.

While many attempts have been made to equalize the tension, none are believed to be simple and effective. Accordingly, a need exists for an improved tension equalization device.

SUMMARY OF THE INVENTION

Consequently, it is an object of the present invention to provide a tension equalizing device for equalizing, or at least reducing the difference in tension, between multiple strands fed as a web.

It is a further object of the invention to utilize an overfeed roll to equalize tension by feeding tighter, or higher tension strands faster to thereby create slack in those strands.

It is another object of the invention to utilize gravity to assist with an overfeed roll to equalize tension across multiple strands.

Yet another object of the invention is to utilize an overfeed roll which contacts yarn along an arc of contact at the bottom half of the overfeed roll so that gravity and friction may assist in equalizing tension across a web.

Accordingly, an overfeed roll is positioned laterally to the direction of feeding of multiple strands. The strands contact the overfeed roll along a bottom portion of the circumference of the overfeed roll. Additionally, the arc which the strands contact the overfeed roll is preferably less than about two hundred and seventy degrees. As tighter strands are fed about the overfeed roll, the overfeed roll feeds these strands at a higher rate until they have similar slip characteristics as the looser strands. This is believed to be opposite of how almost every prior art device operates. Gravity may assist in pulling the strands away from the overfeed roll when the appropriate amount of slack is achieved in a high tension strand.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
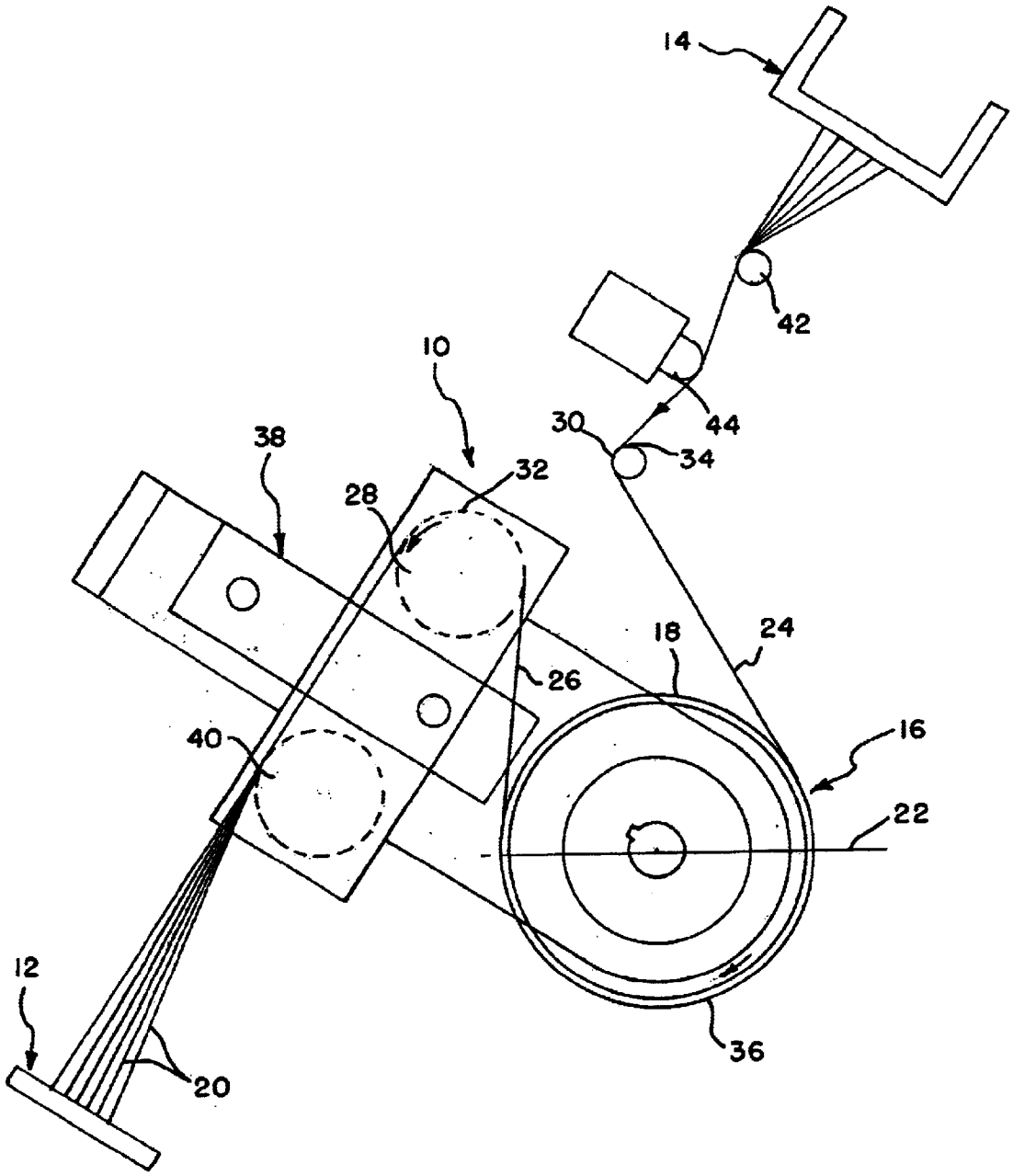
FIG. 1 is a side plan view of a preferred embodiment of the tension device of the present invention.

FIG. 1 shows a first embodiment of a tension device 10 such as may be utilized in conjunction with a tufting machine 12 and a creel 14. While the tension device 10 illustrated is utilized to work with tufting machines, it is believed to have a wide range of applications including other textile industries, tire cord industries, fiber optic industries, and others.

The tension device 10 is comprised of an overfeed roll 16 having a circumference with an exterior surface 18. Strands 20, illustrated as yarn, are directed about a portion of the exterior surface 18 of the overfeed roll 16. The overfeed roll 16 has a higher speed at its exterior surface than the speed at which the strands 20 are fed into the tufting machine 12 of course, for other industries, the tufting machine 12 would be replaced with another device, and the strands 20, may or may not, be yarn.

As shown in FIG. 1, the strands 20 contact the exterior surface 18 of the overfeed roll 16 along a bottom portion of the overfeed roll 16. The arc of contact is preferably less than two hundred seventy degrees, such as approximately one hundred and eighty degrees or the two hundred degrees illustrated in FIG. 1. The arc of contact is also positioned so that very little, if any, of the contact is above the equator axis 22 illustrated. In FIG. 1, about five degrees of contact is illustrated at the left of the overfeed roll 16 above the equator axis 22 and about fifteen degrees of contact is illustrated at the right above the equator axis 22. A limited, if any, amount of contact above the equator axis 22 is believed to assist in preventing yarn which is successfully overfed by the overfeed roll 16, to continue to be overfed such as to create a significant amount of slack above the equator axis 22. Specifically, it would be very undesirable for slack to accumulate on the top portion of the overfeed roll 16 and then continue around the top to make a complete loop as the strands 20 would then get caught up in one another. The exterior surface 18 is preferably a polished metal surface having relatively low friction as opposed to a surface such as sandpaper which would exhibit relatively high friction.

Gravity and friction are believed to play a part in the successful operation of the overfeed roll 16. As the incoming yarn end 24 contacts the exterior surface 18 of the overfeed roll 16, it remains in contact until it leaves as exiting yarn end 26. If a particular yarn end, or strand 20, is at, or below, the desired tension it will slip about the exterior surface of the overfeed roll. However, if the strand 20 is above the desired tension, the friction against the exterior surface pulls that strand 20 at a higher rate until the tension is at, or below, the desired tension. Gravity is believed to assist the process in acting downwardly, or pulling the strands 20 away from the bottom half of the overfeed roll 16. Accordingly, any particular strand 20 can't be overfed significantly, since it will begin to slip off of the overfeed roll 16 as it is overfed and then will be at a lower tension. As the outgoing yarn end 26 is fed into machine 12, even if the strand 20 had slipped completely off of the overfeed roll 16, which is not believed to be likely, it would then be brought back into contact as it is pulled by a feed roll.

Figure 2:
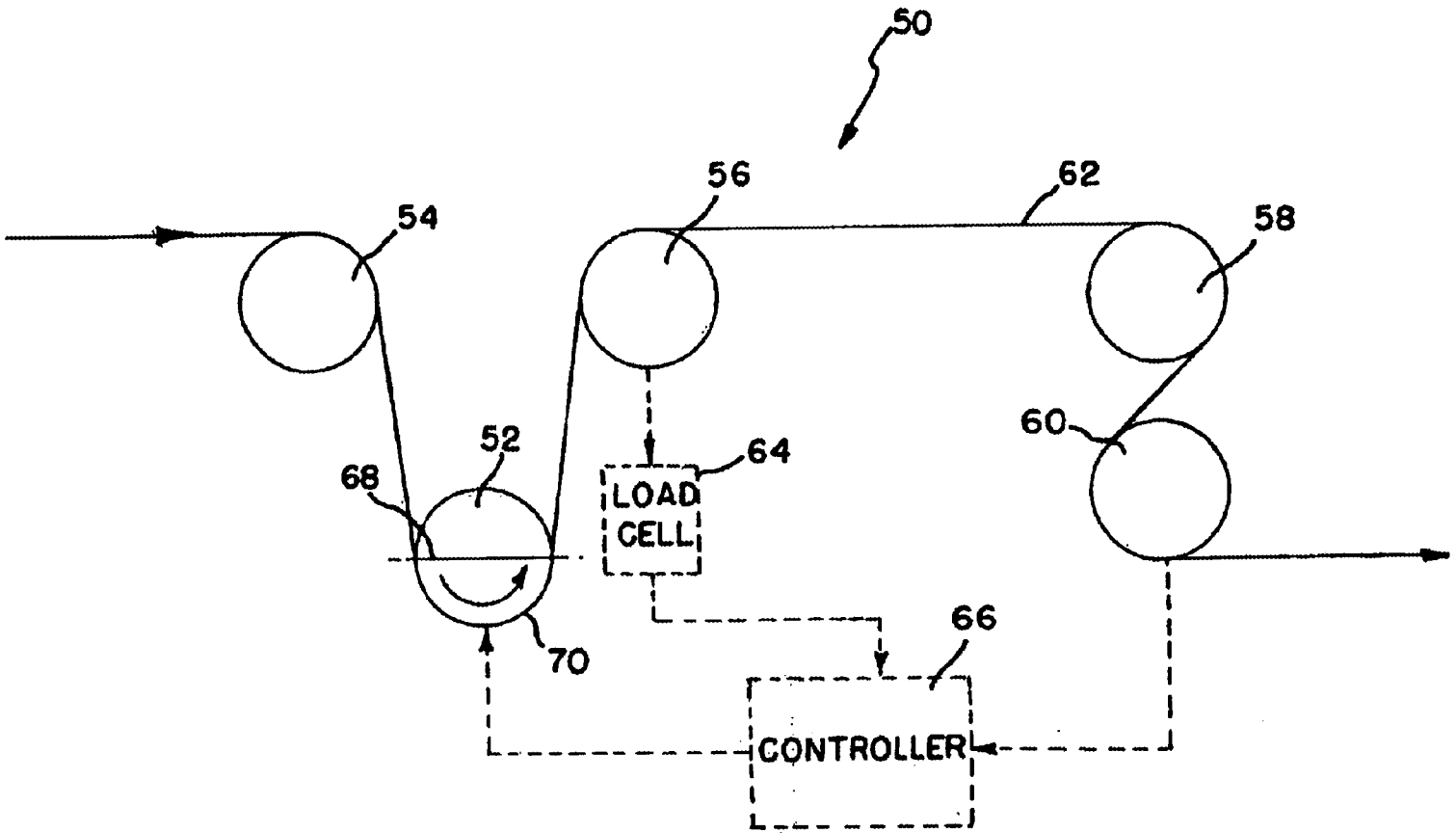
FIG. 2 is a schematic of a second embodiment of a tension device.

In order to facilitate operation of the overfeed roll 16, support rolls 28,30 have been found helpful. The support rolls 28,30 have top portions 32,34 which are located at a higher elevation than the bottom portion 36 of the overfeed roll 16. As illustrated in FIGS. 1 and 2, the support rolls are located completely above the overfeed roll 16, but this need not be the arrangement in all embodiments.

Frame 38 may be utilized to support the overfeed roll 16 as well as one or more support rolls 32. The support roll 32 may also be a feed roll, or a separate feed roll 40 may be utilized and/or connected to the frame 38. A director 42 may receive stands 20 from the creel 14. A load cell 44 may be placed upstream and/or downstream of the overfeed roll 16.

FIG. 2 shows a schematic of a second embodiment of a tension device 50. Once again, an overfeed roll 52 is positioned below two support rolls 54,56. Downstream of the second support roll 56 are the feed rolls 58,60 which pull the web 62 of strands (similar as shown in FIG. 1) for further processing. Load cell 64 is illustrated as being connected to the second support roll 56, but the load cell 64 could be connected to another roll or other object up against any, or all, of the strands in the web 62.

The load cell 64 may measure the tension on any, or all, of the stands in the web 62. The load cell 64 is illustrated as downstream of the overfeed roll 52 which has been found helpful in controlling, such as through controller 66 the speed of the overfeed roll 52. Specifically, if the total tension experienced at the load cell 64 exceeds a selected value, the controller 66 may send a signal to increase the speed of the overfeed roll 52. Conversely, if the tension at the load cell 64 is below a selected value, the controller 64 may send a signal to the overfeed roll 52 to slow down.

The controller 64 is also illustrated as communicating with one of the feed rolls 60. This may be performed utilizing an encoder or tack feedback unit receiving a signal from the feed roll drive, such as at feed roll 60. This has been found helpful for a number of situations including when the speed of the feed roll 60 is adjusted such as when starting, stopping, or other speed change event. Specifically, the overfeed roll 52 may be maintained at a set percentage, such as one hundred, twenty five percent, of the speed of the feed roll 60 during and through a speed change.

In the second embodiment, the tension device 50 has the overfeed roll 52 in contact with the web 62 only below the equator axis 68 at bottom portion 78 of overfeed roll 52. It is illustrated as spanning an arc of less than about one hundred eighty degrees. Depending on the size of the overfeed roll selected, the amount of contact may be less than about one hundred degrees, less than about sixty degrees, or even about thirty degrees of contact. The arc of contact is primarily confined to the bottom portion of the overfeed roll 62, and preferably does not extend above the equator axis 68 as illustrated in FIG. 2.

Figure 3:
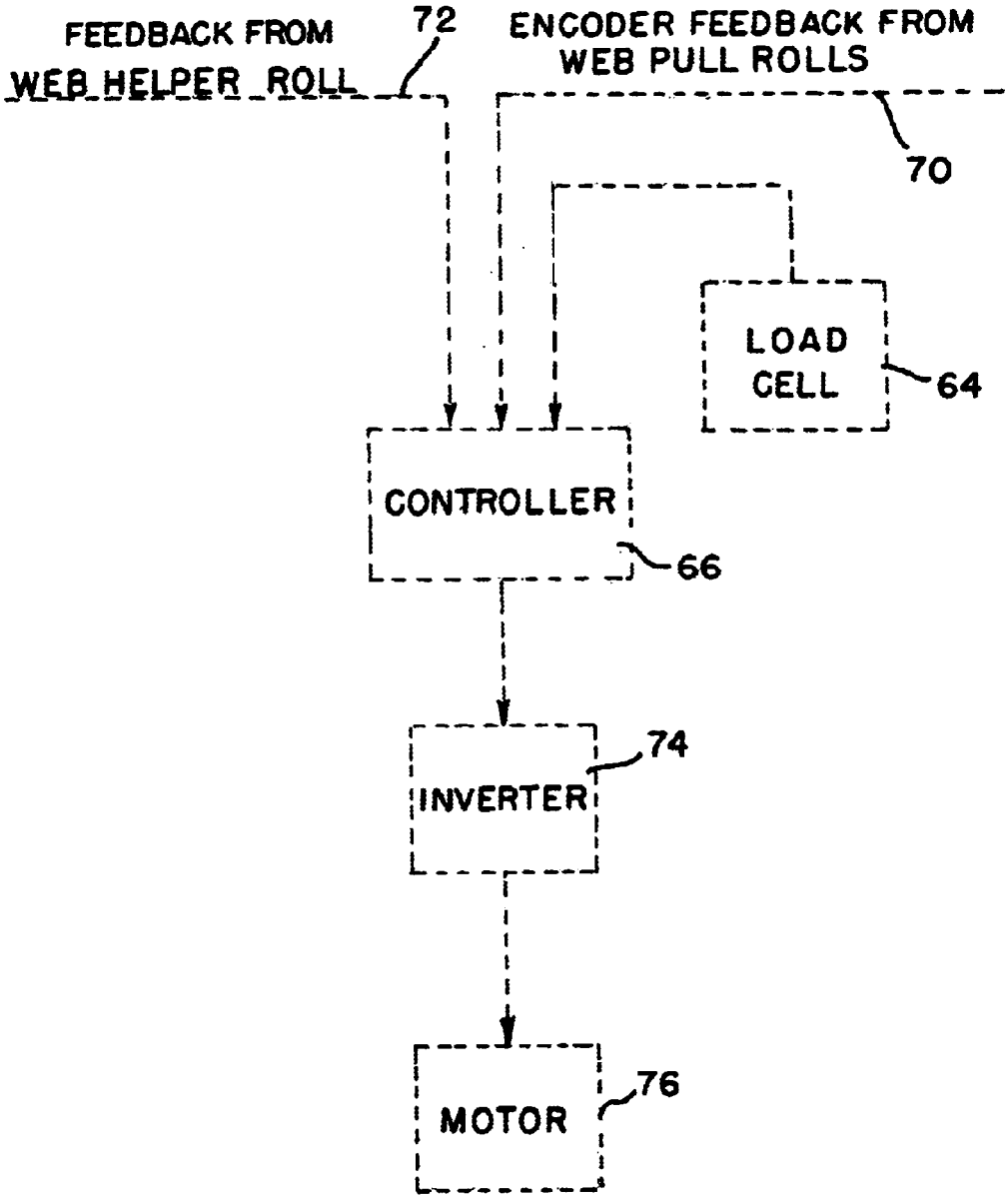
FIG. 3 is an electrical schematic for use with the second embodiment of FIG. 2.

FIG. 3 is second diagram which shows more of the electronic circuitry used with the tension device 50 of FIG. 2. Specifically, the load cell 64 provides a signal, such as feedback, to controller 66. Additional inputs to the controller 66 include a signal 70 from feed roll 60 shown in FIG. 2 and feedback signal 72 from the overfeed roll 52. From the controller 66, a signal is sent to the overfeed roll inverter 74, which may physically be located with the controller or separate therefrom. Finally, a signal is sent to the overfeed roll motor 76 to drive the overfeed roller 52 at a desired speed. Desired speeds are greater than the speed of the feed roll 60, preferably by at least ten, and more preferably at about twenty five percent faster than the speed of the feed roll 60 which is the speed of the web 62 as it is sent to a machine for processing with substantially equal tension across the web 62.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tension device comprising:

an overfeed roll extending laterally to at least a plurality of strands comprising a web, said overfeed roll having an exterior surface and an equator axis extending through a diameter of the overfeed roll defining a top and a bottom half of the overfeed roll, said strands contacting the exterior surface along the bottom half of the overfeed roll at an arc of contact of less than about two hundred seventy degrees; and a feed roll driving the web at a feed rate; said overfeed roll having a speed at its exterior surface greater than the feed rate, wherein strands of the web at or below a desired tension slip relative to the overfeed roll and are fed at the feed rate by the feed roll, and strands having a tension greater than the desired tension are overfed by the overfeed roll to reduce the tension thereon.

2. The tension device of claim 1 wherein the arc of contact is less than about two hundred degrees.

3. The tension device of claim 1 wherein the arc of contact is contained below the equator axis.

4. The tension device of claim 1 wherein the arc of contact is less than about one hundred eighty degrees.

5. The tension device of claim 1 further comprising a first support roll upstream of said overfeed roll and extending substantially parallel with the overfeed roll, said first support roll having a top portion extending a distance above the bottom portion of the overfeed roll, said web directed from the top of the first support roll to the bottom portion of the overfeed roll.

6. The tension device of claim 5 further comprising a second support roll located immediately downstream of the overfeed roll, said second support roll having a top portion extending a distance above the bottom portion of the overfeed roll, and said web is directed from the bottom portion of the overfeed roll across a top portion of the second support roll.

7. The tension device of claim 6 wherein the first and second support rolls are located a distance above the overfeed roll.

8. The tension device of claim 1 further comprising a second support roll located immediately downstream of the overfeed roll, said second support roll having a top portion extending a distance above the bottom portion of the overfeed roll, and said web is directed from the bottom portion of the overfeed roll across a top portion of the second support roll.

9. The tension device of claim 1 further comprising a load cell measuring tension on the web downstream of the overfeed roll and a controller connected to the load cell and the overfeed roll, said controller configured to output a signal to control the speed of the overfeed roll based at least partially upon the signal received from the load cell.

10. The tension device of claim 9 further comprising an input to the controller from the feed roll, and said controller utilizing said input to at least assist in controlling the speed of the overfeed roll.

11. The tension device of claim 9 further comprising an input to the controller from the overfeed roll as a feedback signal, and said controller utilizing the feedback signal to at least assist in controlling the speed of the overfeed roll.

12. The tension device of claim 1 further comprising a controller connected to the overfeed roller and an input to the controller from the feed roll, said control utilizing said input to at least in assist in controlling the speed of the overfeed roll.

13. The tension device of claim 1 further comprising a controller connected to the overfeed roll and an input to the controller from the overfeed roll as a feedback signal, said controller utilizing the feed back signal to at least assist in controlling the speed of the overfeed roll.

14. The tension device of claim 1 wherein the arc of contact does not extend more than about fifteen degrees above the equator axis.

15. The tension device of claim 1 wherein the exterior surface of the overfeed roll is substantially smooth where the strands contact the exterior surface of the overfeed roll.

16. The tension device of claim 1 wherein the speed of the overfeed roll at its exterior surface is at least one hundred ten percent of the feed rate.

17. The tension device of claim 1 wherein the speed of the overfeed roll at its exterior surface is at about one hundred twenty-five percent of the feed rate.

18. The tension device of claim 1 in combination with a creel directing the strands to the overfeed roll.

19. The tension device of claim 1 in combination with a tufting machine configured to receive the web from the feed roll.

* * * * *